US010974088B2

(12) United States Patent
Kukoff

(10) Patent No.: US 10,974,088 B2
(45) Date of Patent: Apr. 13, 2021

(54) AQUATIC EXERCISE DEVICE FOR FULL-BODY WORKOUT AND METHOD OF USE

(71) Applicant: Michael Kukoff, West Orange, NJ (US)

(72) Inventor: Michael Kukoff, West Orange, NJ (US)

( * ) Notice: Subject to any disclaimer, the term of this patent is extended or adjusted under 35 U.S.C. 154(b) by 23 days.

(21) Appl. No.: 16/533,972

(22) Filed: Aug. 7, 2019

(65) Prior Publication Data

US 2020/0047018 A1 Feb. 13, 2020

Related U.S. Application Data

(60) Provisional application No. 62/715,438, filed on Aug. 7, 2018.

(51) Int. Cl.
*A63B 21/008* (2006.01)
*A63B 31/02* (2006.01)
*A63B 35/06* (2006.01)

(52) U.S. Cl.
CPC ..... *A63B 21/0084* (2013.01); *A63B 31/02* (2013.01); *A63B 35/06* (2013.01); *A63B 2208/03* (2013.01); *A63B 2225/605* (2013.01)

(58) Field of Classification Search
CPC ..... A63B 69/12; A63B 35/06; A63B 69/0057; A63B 59/00; A63B 69/125; A63B 69/14; A63B 21/0084; A63B 31/02; A63B 2208/03; A63B 2225/605
See application file for complete search history.

(56) References Cited

U.S. PATENT DOCUMENTS 5,244,393 A * 9/1993 Perry ..... A61H 1/0218 434/254
5,813,945 A * 9/1998 Bernacki ..... A63B 21/153 434/247
7,104,932 B1 * 9/2006 Brentlinger ..... A63B 69/12 434/254
2016/0175655 A1 * 6/2016 Kacar ..... A63B 69/14 441/129

* cited by examiner

*Primary Examiner* — Nyca T Nguyen
*Assistant Examiner* — Andrew M Kobylarz
(74) *Attorney, Agent, or Firm* — MG Miller Intellectual Property Law LLC

(57) ABSTRACT

An aquatic exercise device and method of use are described herein. The aquatic exercise device provides for a full body, low impact, and decompressing workout that is unattainable by any existing product on the market. The aquatic exercise device features a buoy, a fastening mechanism, a user attachment mechanism, and a bridge connecting the buoy, the fastening mechanism, and the user attachment mechanism.

10 Claims, 4 Drawing Sheets

AQUATIC EXERCISE DEVICE FOR FULL-BODY WORKOUT AND METHOD OF USE

CLAIM OF PRIORITY

This application claims priority to U.S. Provisional Patent Application No. 62/715,438, filed on Aug. 7, 2018, entitled "AQUATIC EXERCISE DEVICE FOR FULL-BODY WORKOUT AND METHOD OF USE", the contents of which are hereby incorporated by reference in their entirety.

NOTICE OF COPYRIGHTS AND TRADE DRESS

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure, as it appears in the Patent and Trademark Office patent files or records, but otherwise reserves all copyright and trade dress rights whatsoever.

FIELD OF THE EMBODIMENTS

The present disclosure relates generally to an aquatic exercise device. More particularly, the present disclosure relates to an aquatic exercise device that can be used to provide a full-body, impact free, decompressing workout for the user.

BACKGROUND

The health benefits of exercise are too important to ignore. Physical activity not only builds strength and increases energy, but also prevents the development of certain diseases, including obesity, type 2 diabetes, high blood pressure, and cardiovascular heart disease. According to the Center for Disease Control and Prevention, "regular physical activity helps improve your overall health and fitness and reduces your risk for many chronic diseases."

Due to the preceding health benefits, the demand for effective fitness regimes has led to a market profusion of exercise equipment, classes, and trends. Despite this, one unmet need still persists: namely, a device that enables a total body, impact free, and decompressing workout. This need represents a long-felt but unfulfilled market gap.

Today, in an effort to reap the health benefits of physical activity, people engage in quintessential exercise forms such as running and using an elliptical machine. However, neither of these activities satisfies the objectives of being a total body, impact free, and decompressing workout.

Running is a high-impact form of exercise that often leads to joint pain, arthritis, shin splints, muscle sprains, and other injuries. While running keeps muscles throughout your body in constant motion, the excessive bodily strain that is characteristic of running leads to spinal, joint, and muscle compression. Spinal compression often results in symptoms including back pain and stiffness and nerve problems that can affect emotional and cognitive processes.

Individuals who recognize the drawbacks of running may see the elliptical machine as a suitable alternative, as it is a low impact fitness activity. However, perhaps the most significant disadvantage of the elliptical machine is that it fails to provide a total body workout. That is, elliptical workouts do not necessarily target one's core or calves, among other muscles.

Accordingly, those interested in exercising all of their muscle groups are forced to supplement their elliptical workout with additional training programs, inevitably increasing the duration of their exercise routine.

Adding further time to one's workout is not a practical option for many Americans. According to the Office of Disease Prevention and Health Promotion, "adults should do at least 150 minutes (two hours and 30 minutes) a week of moderate-intensity, or 75 minutes (one hour and 15 minutes) a week of vigorous-intensity aerobic physical activity." In 2016, 22.5% of adults met this objective. This supports the conclusion that most people do not have excesses of time to dedicate to extending their workout.

Those who recognize the issues associated with running and the elliptical machine may see swimming as a viable replacement. While swimming is impact free and typically does not lead to any drawbacks such as spinal compression, it is a restrictive form of exercise in that swimmers are limited to a finite amount of possible bodily strokes. It follows that there is a fixed amount of ways to workout muscle groups while swimming.

There is a need for a device that expands the finite scope of aquatic exercise, while also enabling a workout that is total body, impact free, and decompressing. Currently, a way for a person to exercise in this way is completely unavailable.

The present invention and its embodiments meets and exceeds these objectives.

While these units may be suitable for the particular purpose employed, or for general use, they would not be as suitable for the purposes of the present disclosure as disclosed hereafter.

In the present disclosure, where a document, act, or item of knowledge is referred to or discussed, this reference or discussion is not an admission that the document, act, item of knowledge, or any combination thereof that was known at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed. It is contemplated that the claims may encompass one or more of the conventional technical aspects discussed herein.

SUMMARY

An aspect of an example embodiment in the present disclosure is to provide an aquatic exercise device for a full-body workout and its method of use. Accordingly, the present disclosure provides an aquatic exercise device for use in a full-body workout that is impact free and decompressing. The aquatic exercise device features a buoy, a fastening mechanism, a bridge, and a user attachment mechanism.

The buoy has a top portion, a bottom portion, a front face extending from the top portion to the bottom portion, and a rear face extending from the top portion to the bottom portion. The buoy also has a left side extending from the top portion to the bottom portion and from the front face to the rear face, as well as a right side which extends from the top portion to the bottom portion and from the front face to the rear face, and a bridge channel defined by a conduit having a first opening on the front face and a second opening on the rear face. In many embodiments, the conduit extends from the front face to the rear face.

The fastening mechanism includes a first bridge attachment mechanism and means for fastening the aquatic exercise device to a non-human object. The fastening mechanism is used to removably attach the aquatic exercise device to an object such as the wall of a pool, a tree on a beach, a lane line, or some similar device that will remain substantially static when force is exerted on or away from it.

The user attachment mechanism features user attachment mechanism interface and a means for attaching the aquatic exercise device to a part of a human user. The user attachment mechanism is aptly named; it is used to attach the aquatic exercise device to the user. In a highly preferred embodiment, the user attachment mechanism is adjustable and can be attached to various parts of the user, such as the user's waist or around the user's knees.

The bridge is preferably comprised of a cable having a first end and a second end where the first end is equipped with a fastening mechanism interface for attaching the cable to the fastening mechanism of the aquatic exercise device. The second end is equipped with a user attachment mechanism interface used to attach the cable to the user attachment mechanism. The bridge also extends through the conduit and preferably the buoy is able to move freely along the length of the bridge.

In a number of preferred embodiments, the user attachment mechanism features a comfort fitted sleeve around the user attachment mechanism. This is to provide additional comfort for the user. Preferably this sleeve is padded. In other various embodiments, the buoy has a single continuous curve defining its various portions. In some embodiments, both the left side and the right side are a concave curve. In other embodiments, both the left side and the right side are convex curves. In yet another embodiment, the buoy will have both concave and convex curves. Preferably, the buoy is shaped to fit securely between the legs of a human user so that it will remain in position during the user's workout.

The aquatic exercise device in accordance with the present disclosure enables an abdominal, aerobic, and anaerobic workout while providing bodily decompression with minimal impact on the joints of the body.

It is contemplated that in a preferred embodiment, the front face, the top portion, and the rear face make a first width, and the front face, the bottom portion, and the rear face comprise a second width. The first width may be smaller, larger, or equal to the second width, depending on the user's preference. The bridge channel may also be equipped with a sleeve which allows the bridge to generate reduced friction when passing through the bridge channel.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

Implementations may include one or a combination of any two or more of the aforementioned features.

These and other aspects, features, implementations, and advantages can be expressed as methods, apparatuses, systems, components, program products, business methods, and means or steps for performing functions, or some combination thereof.

Other features, aspects, implementations, and advantages will become apparent from the descriptions, the drawings, and the claims.

BRIEF DESCRIPTION OF THE PREFERRED EMBODIMENTS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete, and fully conveys the scope of the present disclosure to those skilled in the art. In fact, it will be apparent to those skilled in the art that various modifications and variations can be made in the present invention without departing from the scope or spirit of the invention.

DETAILED DESCRIPTION OF THE PREFERRED EMBODIMENTS

Figure 1:
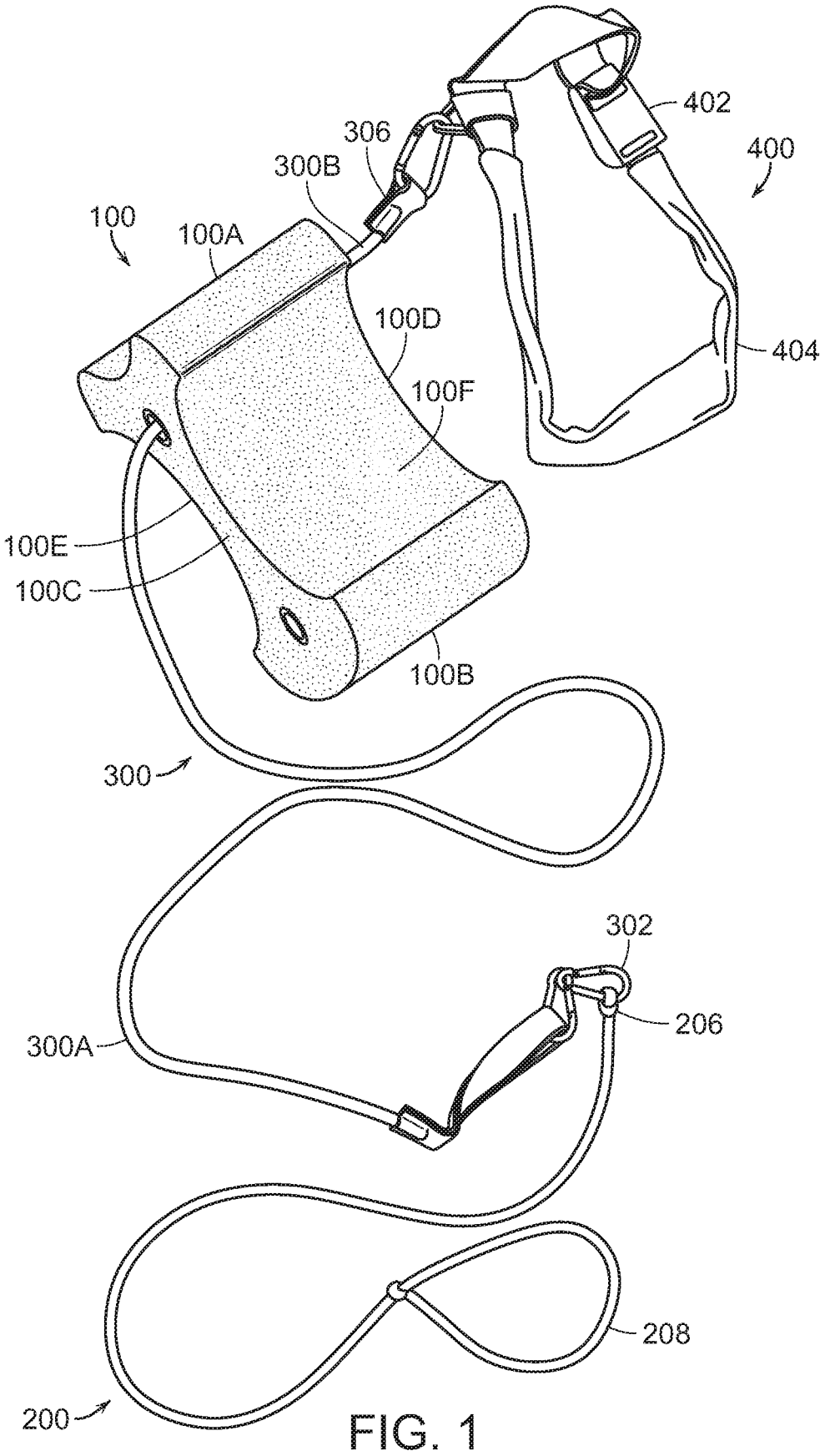
FIG. 1 is a perspective view of an embodiment of the aquatic exercise device in accordance with the present disclosure.
Figure 2A:
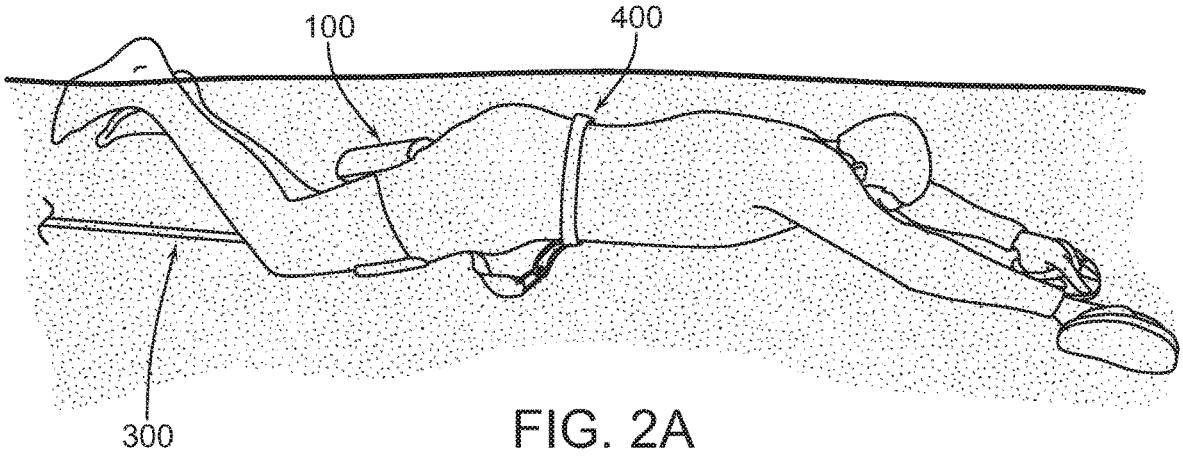
FIG. 2A is a side view of an embodiment of the aquatic exercise device in accordance with the present disclosure, in use by a human user in a first position.
Figure 2B:
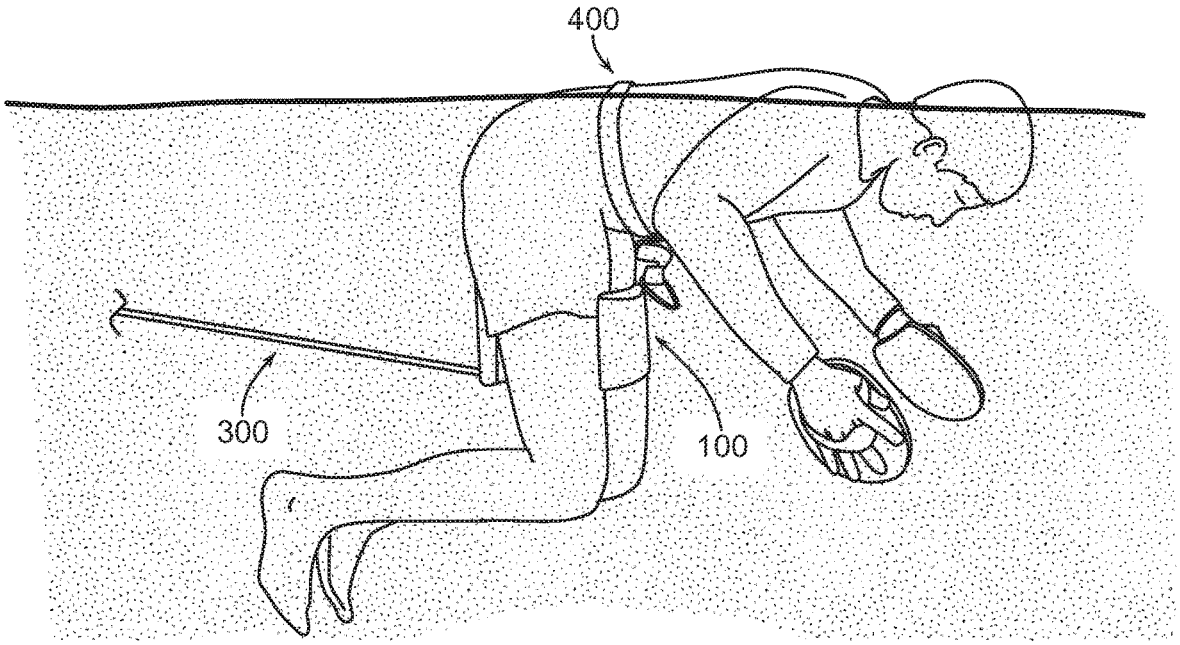
FIG. 2B is a side view of an embodiment of the aquatic exercise device in accordance with the present disclosure, in use by a human user in a second position.
Figure 3A:
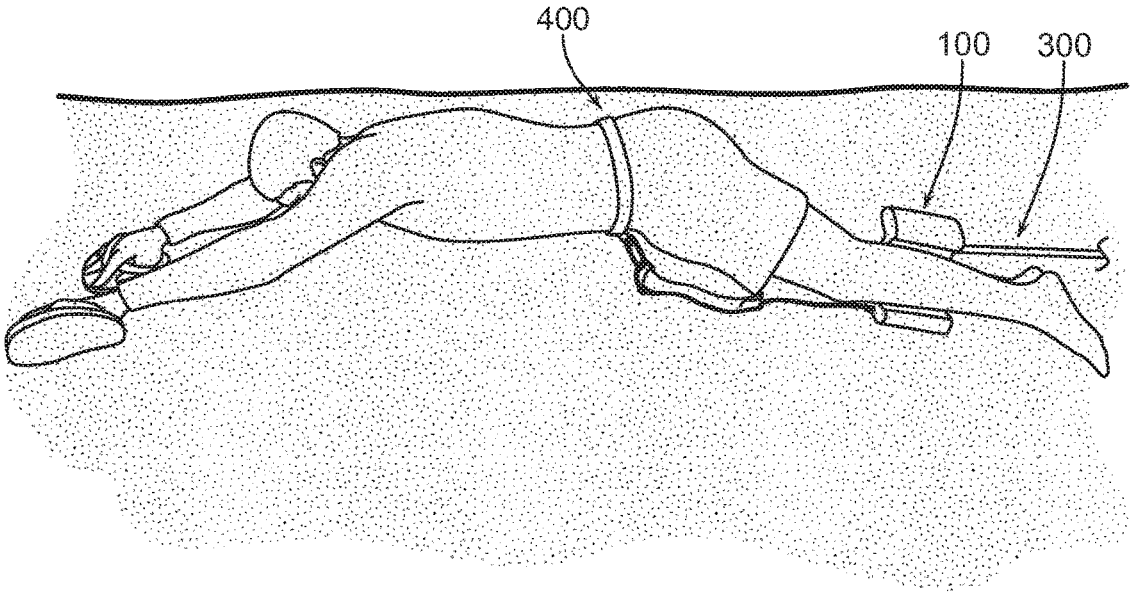
FIG. 3A is a side view of an embodiment of the aquatic exercise device in accordance with the present disclosure, in use by a human user in a third position.
Figure 3B:
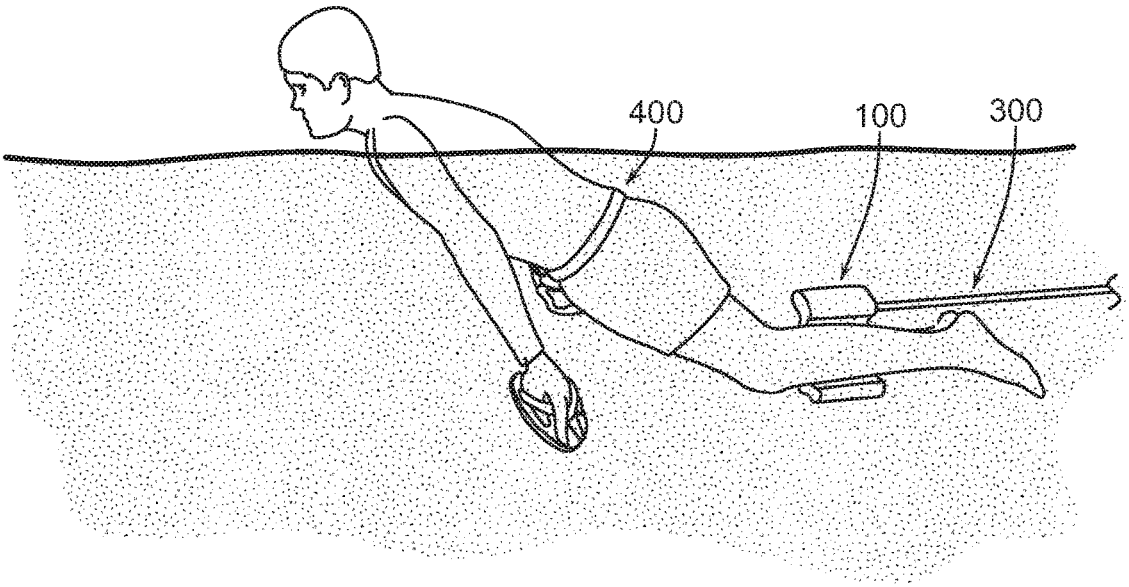
FIG. 3B is a side view of an embodiment of the aquatic exercise device in accordance with the present disclosure, in use by a human user in a fourth position.

FIG. 1 illustrates an embodiment of the aquatic exercise device in accordance with the present disclosure. Here, the aquatic exercise device features a buoy 100, a fastening mechanism 200, a bridge 300, and a user attachment mechanism 400. The buoy 100 includes a top portion 100A, a bottom portion 100B, and a front face 100C that extends therebetween. The buoy 100 also includes a rear face 100D, which also extends between the top portion 100A and the bottom portion 100B. The buoy 100 features a left side 100E and a right side 100F, which both span the top portion 100A, the bottom portion 100B, the front face 100C, and the rear face 100D. Note that the buoy 100 may be used as a safety flotation device when detached from the rest of the aquatic exercise device. The buoy 100 may also be sized differently to accommodate users of different sizes.

In addition to the buoy 100, this embodiment of the aquatic exercise device includes the fastening mechanism 200 to be used to attach the aquatic exercise device to a fixed object. That is, the aquatic exercise device should be attached to something that will provide a counterforce when the aquatic exercise device is pulled away from it. Such a fixed object may include the wall of a pool, a tree adjacent to a natural body of water, a lane line in a pool, and the like. The only limitation that suitable fixed objects have is that these objects must be able to resist the force of a user pulling the aquatic exercise device away from said objects. It is important to note that the aquatic exercise device may still be used without engaging the fastening mechanism 200. The fastening mechanism 200 includes a bridge attachment mechanism 206 and a means for attaching the fastening mechanism 208 to said fixed object. Preferably, the means for attaching the fastening mechanism 208 will be a rope that is tied either to or around the fixed object. However, other suitable means for attachment exist such as a hook, a loop, a magnet if the fixed object is magnetic, a nut/bolt combination, a screw, one or more hook and loop fasteners, and the like. The bridge attachment mechanism 206 can also be any kind of device that provides for the removable attachment to the bridge, but is preferably a carabineer removably attached to the bridge 300.

The bridge 300 has a first end 300A and a second end 300B. Preferably, the first end 300A is equipped with a fastening mechanism interface 302 used to interface the bridge 300 with the fastening mechanism 200. The fastening mechanism interface 302 must be able to be pulled with a reasonable amount of force without detaching from the fastening mechanism 200. The second end 300B is equipped with a user attachment mechanism interface 306 for interfacing with the user attachment mechanism 400. Much like the fastening mechanism interface 302, the user attachment mechanism interface 306 must be able to withstand a reasonable amount of force without detaching from the user attachment mechanism 400. Preferably, the fastening mechanism interface 302 and the user attachment mechanism interface 306 provide for the removable attachment of the fastening mechanism 200 and the user attachment mechanism 400 from the bridge 300, respectively. This has the benefit of allowing a user to easily substitute various components of the aquatic exercise device should one component break without having to replace the entire aquatic exercise device. Preferably, the bridge 300 is constructed from a flexible material, although in some embodiments it is constructed out of a substantially rigid material. In a highly preferred embodiment, the bridge 300 is constructed out of one or more bungee cords. The bridge 300 is threaded through the bridge channel 112 (See FIG. 4) before terminating at the first end 300A. The buoy 100 is able to move freely along the bridge 300. This movement is facilitated when conduit 110 (See FIG. 4) is equipped to reduce friction between the buoy 100 and the bridge 300, and to prevent the bridge 300 from snagging on the bridge channel 112 (See FIG. 4). The conduit 112 (See FIG. 4) also prevents undue wear on the buoy 100 caused by friction between the buoy 100 and the bridge 300.

Finally, the user attachment mechanism 400 includes a means for attachment 402 to a human user. Preferably, the means for attachment 402 will be an adjustable belt that can be positioned around the user's waist, or above or below the user's knees. In various embodiments, the position for the means for attachment 402 can be varied throughout the course of a workout. That is, a user may position the means for attachment 402 at the user's ankles for a portion of the workout and may position the means for attachment 402 at the user's knees for another portion of the workout. If the means for attachment 402 is an adjustable belt, the aquatic exercise device may be used on human users of various sizes, and on human users whose waist has a different diameter. In some embodiments, the means for attachment 402 is equipped with a comfort casing 404. This comfort casing 404 is preferably padded to increase the user's comfort when operating the aquatic exercise device. The means for attachment 402 may also be a series of hook and loop fasteners attached to a strap, a ratchet strap, a fixed elastic loop, an adjustable elastic loop, a string, a magnetically fastened loop, or any other device that allows the user attachment mechanism 400 to be removably attached to the waist or legs of a human user. Whether or not the user attachment mechanism 400 is removably attached to the waist or legs of the user will provide for different levels of resistance or will provide for different types of exercises that can be performed with the aquatic exercise device.

FIGS. 2A, 2B, 3A, and 3B all show an embodiment of the aquatic exercise device in use by a human user. Of note is how many positions exist where the means for attachment 402 is secured around the human user's base, while the buoy 100 can be position in between the user's thighs (FIGS. 2A and 2B), in between the user's calves (FIGS. 3A and 3B), or in between the user's ankles (not shown).

Figure 4:
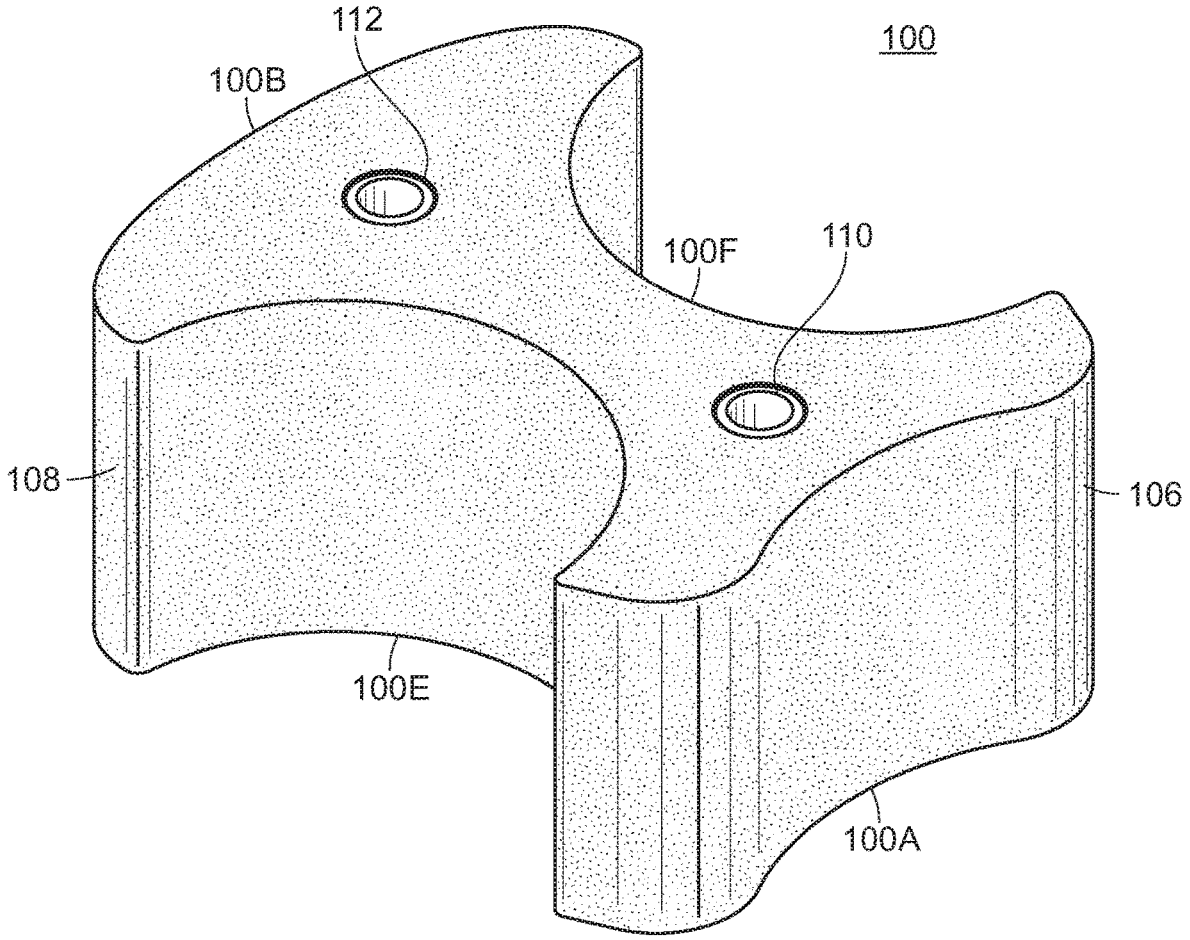
FIG. 4 is a perspective view of an embodiment of the buoy in accordance with the present disclosure.

Referring to FIG. 4, a perspective view of an embodiment of the buoy 100 is shown. Here, the top portion 100A, the left side 100E, and the right side 100F form a first width 106. Also shown here is the bottom portion 100B, the left side 100E, and the right side 100F form a second width 108. The buoy also features a bridge channel 112, which has a conduit 110. This embodiment also features a bridge channel 112 which extends completely through the buoy 100, as well as conduit 110, which interfaces with the bridge channel 112 to reinforce the same. In FIG. 4, a first width 106 is smaller than a second width 108. There exist other embodiments where the first width 106 is larger than the second width 108. Also shown in FIG. 4 is the top portion 100A as a concave curve and the bottom portion 100B is a convex curve. By providing these alternative embodiments of the buoy 100, it is possible to increase or decrease the amount of resistance the buoy 100 creates when traveling through the water. This correlates to a more difficult or an easier workout when the aquatic exercise device is in use.

The present disclosure also contemplates a wide variety of exercises that can be performed with the aquatic exercise device. Such exercises include number variations of traditional breaststroke, variations of traditional backstroke, variations of traditional butterfly, variations of traditional front crawl, various abdominal movements done in conjunction with the aforementioned traditional strokes, underwater burpees, various movements aside from the traditional strokes to work muscle groups unused by said strokes. Other exercises include, bringing a user's knees to their chest with the aquatic exercise device positioned proximate to the user's knees. This can be performed by bringing the user's knees directly towards their chest, or can be done an on angle to engage their oblique muscles. Additionally, a user may select different distances from the point-of-fixation to reach. The further away the selection, the greater the challenge it will be to reach.

In various embodiments, the aquatic exercise device in accordance with the present disclosure can be equipped with a number of accessories. Such accessories include different tension bands in offer different resistance in the bridge, weights to be attached to the aquatic exercise device to allow it to be anchored or partially anchored to the bottom of a body of water, hand paddles or gloves to be worn by the user, as well as attachments for the user's legs to enable additional lower body workouts. Further, markers may be used to give the user direction as to how far to travel in the water. The markers can be weights that drop to the bottom of the body of water to provide points of reference for the user.

As noted above, these exercises will consist of a combination of various traditional swimming movements, however there are many more variations of movements that can be achieved with the aquatic exercise device that are not performed typically by swimmers. The device therefore provides for a combination of upper body, leg, and abdominal movements in unison. Moreover, all of this is achieved while providing impact free bodily decompression which can aid users with spinal, back, and leg ailments. Further, the aquatic exercise device in accordance with the present disclosure can speed up the healing process of an injured user due to the low-impact and decompressing exercises that can be performed with said device.

In a preferred embodiment, the aquatic device in accordance with the present disclosure can be used in water aerobic exercise programs, as well as for recreational use in large natural bodies of water, such as oceans or lakes.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," and "third," are used herein to describe various elements, components, regions, layers and/or sections, these elements, components, regions, layers and/or sections should not be limited by these terms. These terms are only used to distinguish one element, component, region, layer and/or section from another element, component, region, layer and/or section. Thus, a "first element," "component," "region," "layer" and/or "section" discussed below could be termed a second element, component, region, layer and/or section without departing from the teachings herein.

Features illustrated or described as part of one embodiment can be used with another embodiment and such variations come within the scope of the appended claims and their equivalents.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In conclusion, herein is presented an aquatic exercise device for full-body workout and method of use. The disclosure is illustrated by example in the drawing figures, and throughout the written description. It should be understood that numerous variations are possible while adhering to the inventive concept. Such variations are contemplated as being a part of the present disclosure.

What is claimed is:

1. An aquatic exercise device for use in a full-body workout, comprising:

a buoy having a top portion, a bottom portion, a front face extending from the top portion to the bottom portion, a rear face extending from the top portion to the bottom portion, a left side extending from the top portion to the bottom portion and from the front face to the rear face, a right side extending from the top portion to the bottom portion and from the front face to the rear face, and a bridge channel defined by a conduit having a first opening on the front face and a second opening on the rear face, wherein the conduit extends from the front face to the rear face;

a fastening mechanism comprising a first bridge attachment mechanism and a means for fastening the aquatic exercise device to a non-human object;

a user attachment mechanism comprising a second bridge attachment mechanism and a means for attaching the aquatic exercise device to a part of a human user; and a bridge comprising a cable having a first end and a second end, wherein the first end is equipped with a fastening mechanism interface, wherein the second end is equipped with a user attachment mechanism interface, wherein the bridge is fixed to the fastening mechanism via the fastening mechanism interface, extends through the conduit, and is fixed to the user attachment mechanism via the user attachment mechanism interface.

2. The aquatic exercise device of claim 1, wherein the front face, the top portion, and the rear face comprise a first width, wherein the front face, the bottom portion, and the rear face comprise a second width.

3. The aquatic exercise device of claim 2, wherein the bridge channel is equipped with a sleeve configured to allow the bridge to generate reduced friction when passing through the bridge channel.

4. The aquatic exercise device of claim 3, wherein the first width is larger than the second width.

5. The aquatic exercise device of claim 3, wherein the first width is smaller than the second width.

6. The aquatic exercise device of claim 3, wherein the first width is equal to the second width.

7. The aquatic exercise device of claim 1, wherein the front face comprises a concave curve.

8. The aquatic exercise device of claim 7, wherein the rear face comprises a convex curve.

9. The aquatic exercise device of claim 1, the user attachment mechanism further comprising a comfort casing partially-enveloping the means for attaching the aquatic exercise device to the part of the human user.

10. The aquatic exercise device of claim 1, wherein the left side and the right side comprise a concave curve.

* * * * *